US006371687B1

(12) United States Patent
Heintz et al.

(10) Patent No.: US 6,371,687 B1
(45) Date of Patent: Apr. 16, 2002

(54) METHOD AND APPARATUS FOR LEVELING MANHOLE COVER FRAMES

(76) Inventors: Marc S. Heintz, 2804 Buckhart St., SE. Albany, OR (US) 97321; James L. Ableman, 182 Azalea - Adair, Corvallis, OR (US) 97330

( * ) Notice: Subject to any disclaimer, the term of this patent is extended or adjusted under 35 U.S.C. 154(b) by 0 days.

(21) Appl. No.: 09/499,583

(22) Filed: Feb. 7, 2000

Related U.S. Application Data

(60) Provisional application No. 60/119,432, filed on Feb. 9, 1999.

(51) Int. Cl.[7] ..... E02D 29/14

(52) U.S. Cl. ..... 404/26; 52/20; 52/25

(58) Field of Search ..... 404/26, 25; 52/19, 52/20, 25, 126.1; 248/316.7, 188.4, 231.81

(56) References Cited

U.S. PATENT DOCUMENTS

| | | | | | |
|---|---|---|---|---|---|
| 1,076,386 | A | | 10/1913 | O'Day | 404/26 |
| 2,930,295 | A | | 3/1960 | Hale | 404/26 |
| 3,263,579 | A | | 8/1966 | Dorris | 404/26 |
| 3,771,273 | A | * | 11/1973 | Brodie | 52/646 |
| 3,773,428 | A | * | 11/1973 | Bowman | 404/26 |
| 4,075,796 | A | | 2/1978 | Cuozzo | 52/20 |
| 4,202,083 | A | * | 5/1980 | Gutner | 29/897 |
| 4,225,266 | A | | 9/1980 | Fier | 404/26 |
| 4,281,994 | A | * | 8/1981 | Bowman | 404/26 |
| 4,466,219 | A | | 8/1984 | Campolito | 52/20 |
| 4,618,464 | A | | 10/1986 | Ditcher | 264/35 |
| 4,915,334 | A | * | 4/1990 | White | 248/188.4 |
| 4,976,568 | A | | 12/1990 | Hess | 404/26 |
| 5,143,478 | A | | 9/1992 | Bowman | 404/26 |
| 5,344,253 | A | * | 9/1994 | Sacchetti | 404/26 |
| 5,628,152 | A | * | 5/1997 | Bowman | 52/20 |
| 5,666,769 | A | * | 9/1997 | Lundquist | 52/126.1 |
| 6,007,270 | A | * | 12/1999 | Bowman | 202/25 |
| 6,039,294 | A | * | 3/2000 | Chen | 248/188.4 |

* cited by examiner

*Primary Examiner*—David Bagnell
*Assistant Examiner*—Katherine Mitchell
(74) *Attorney, Agent, or Firm*—Dellett and Walters

(57) ABSTRACT

A manhole cover frame leveling clip, that attaches by a friction fit to the exterior peripheral flange of a manhole cover frame, and uses an adjustable bolt running through the clip, to manipulate the height and angle of the frame so that the frame is in the same plane or the correct elevation with the finished grade of the roadway surface.

26 Claims, 3 Drawing Sheets

METHOD AND APPARATUS FOR LEVELING MANHOLE COVER FRAMES

This application claims benefit under 35 U.S.C. section 119(e) of U.S. provisional patent application 60/119,432, filed Feb. 9, 1999.

BACKGROUND OF THE INVENTION

This invention relates to manhole/maintenance access hole installation during roadway construction and more particularly to an apparatus that attaches to a manhole cover frame, allowing the manhole cover to be adjusted until it is parallel with and in the same plane with the proposed final or final finished grade of the surfaced roadway.

When resurfacing an existing roadway or installing new roads with manholes, it is difficult to position the manhole cover frame accurately so that it is flush with the proposed finished grade of the roadway surface. Manholes are most prevalently made in precast concrete sections and a common configuration consists of a manhole base upon which standard precast manhole sections interlockingly stack. Since the manholes are not necessarily perpendicular to the roadway surfaces, these standard precast manhole sections terminate below grade. Shorter, lighter precast riser rings are interlockingly placed on the top manhole section. Grout or other suitable material is then used between these riser rings and the manhole section to adjust the top end of the riser rings parallel to the proposed grade of the roadway surface. A manhole cover frame, which is typically a large cylindrical cast iron section with internal and external flanges, is placed onto the riser rings. However, since the manhole cover frame weighs hundreds of pounds but must be precisely placed so as to be flush with the finished surface of the roadway and since the riser rings are only roughly positioned with respect to the contour and elevation of the roadway surface, the manhole cover cannot just rest directly upon the precast concrete riser rings, but must be adjusted to precise height and angle relative to the riser rings. Due to the extreme weight of the manhole cover frame, accomplishing precise alignment is difficult. Typically the cover frame is held in proper alignment by the placement of stones or other debris, which may be handy, between the manhole cover frame and the riser rings.

Referring to FIG. 1, a cross sectional view of a typical manhole cover frame 10, the frame includes an outer peripheral flange 12 that is supported directly on the top surface of a riser ring 14. The riser rings 14 have been adjusted to conform with the roadway grade 18 by the strategic placement of a grout 16 between riser rings 14.

An alternate method of alignment is to suspend the manhole cover frame by wire from dimensional lumber that rests on the finished grade of the roadway.

Prior patents for manhole leveling devices also disclose several methods for aligning the manhole frame to the finished roadway surface. U.S. Pat. No. 1,076,386 discloses using leveling screws but requires special fabrication of the cover frame to incorporate brackets to house and support the screws. U.S. Pat. No. 4,075,796 shows a specially fabricated cover frame with an internally threaded body that adjusts for height only. U.S. Pat. No. 3,263,579 also discloses using leveling screws but requires a specially fabricated flange from which the leveling screws operate. U.S. Pat. No. 2,930,295 uses screws to align the manhole cover but requires the fabrication of a two-piece cover frame.

SUMMARY OF THE INVENTION

The present invention provides a cost effective apparatus and method for precise alignment of a manhole cover frame to a proposed roadway surface that requires no modifications to existing manhole components, nor requires any additional steps in the manufacture of existing manhole components.

This invention comprises a clip that fastens to the outer peripheral flange on a manhole cover frame. The clip is threaded to allow a leveling bolt to raise or lower the manhole cover frame with respect to the topmost manhole precast riser ring, allowing for the perfect alignment of the manhole cover frame with the roadway surface. The individual clips may be positioned anywhere along the peripheral flange of the cover frame in accordance with the contour of the roadway surface.

Accordingly, it is an object of the present invention to provide an improved low cost manhole cover frame leveling apparatus.

It is a further object of the present invention to provide an improved manhole cover frame leveling apparatus that requires no modifications to existing manhole components.

It is yet another object of the present invention to provide an improved manhole cover frame leveling apparatus that requires minimal time, effort and equipment to install and to use.

It is yet another object of the present invention to provide an improved leveling clip that is suitable for performing a variety of construction leveling tasks with respect to installation of gratings, covers and the like.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figure 1:
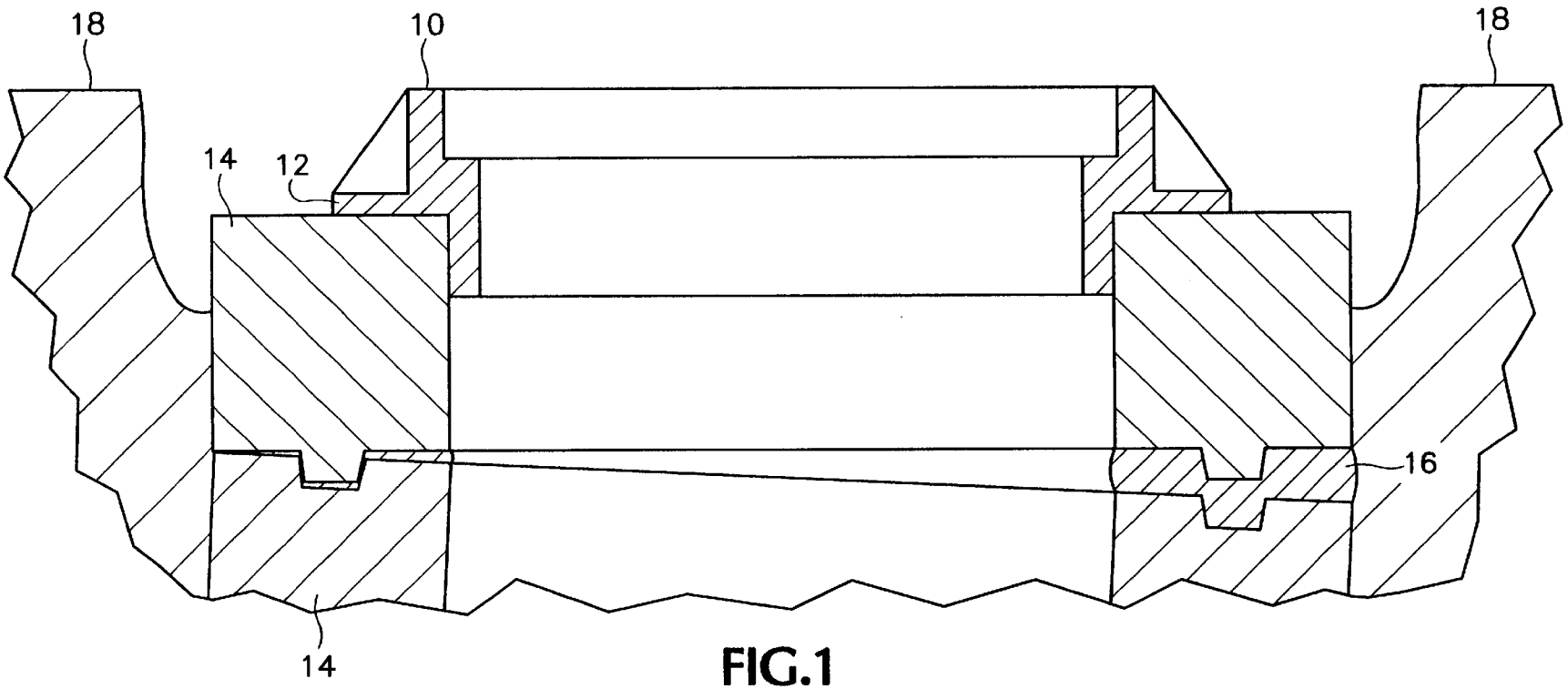
FIG.1 (PRIOR ART)
FIG. 1 is a cross sectional view of a typical prior art leveled manhole.
Figure 2:
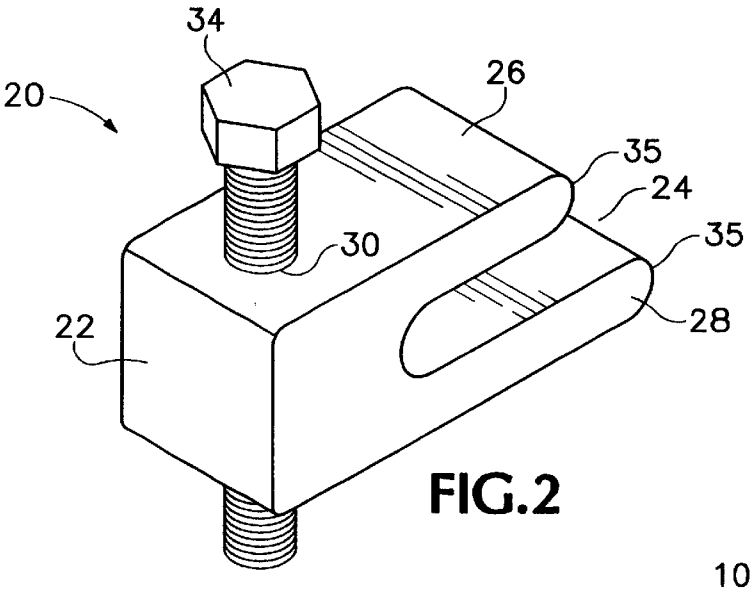
FIG. 2 is a perspective view of a manhole frame leveling clip according to the present invention.

FIG. 2 is a perspective view of the leveling apparatus according to the preferred embodiment of the present invention. A leveling clip 20 is provided comprising a substantially rectangular body 22 with a "U" shaped channel 24 running parallel to and equidistant between the sides having the largest surface area to form two "legs" 26 and 28. In the preferred embodiment, one of the legs, leg 26, is somewhat shorter than leg 28 and both legs have rounded over leading edges 35 for ease of installation, although these are not requirements. The channel 24 extends to a depth exceeding the midpoint of the longitudinal axis of the body 22. Adjacent the end of the clip which is distal from the opening of the "U" shaped channel 24, a hole 30 is defined which is threaded in the illustrated embodiment to receive a standard commercial steel bolt 32. The bolt 32 provides adjustment features as discussed hereinbelow and is suitably sized so as to be able to bear the compressive force load of the manhole cover frame.

Figure 3:
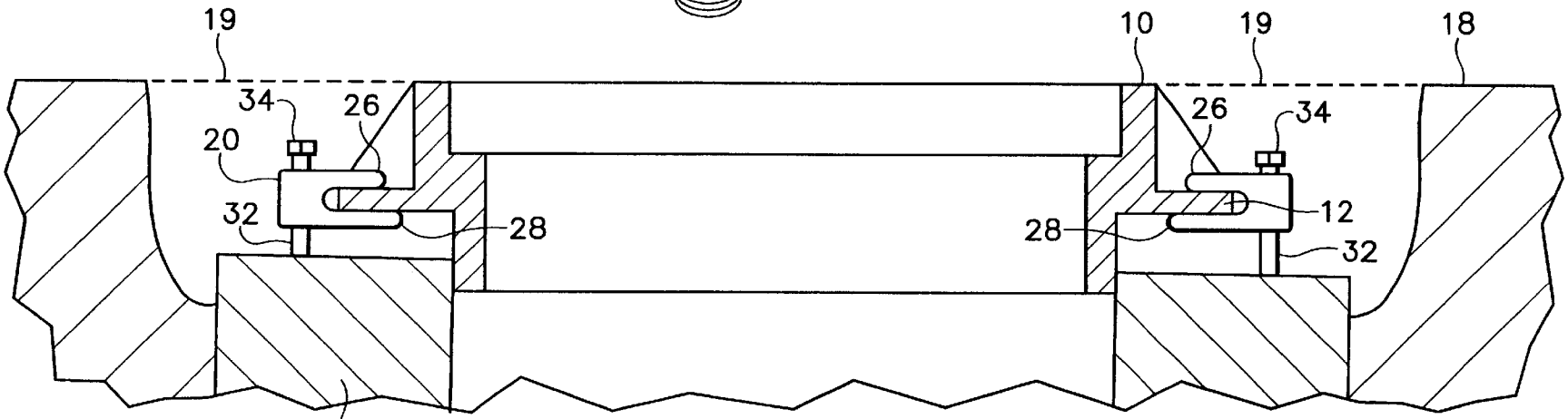
FIG. 3 is a cross sectional view of the manhole frame leveling clip as installed and properly aligning a manhole cover frame.

Referring to FIG. 3, which is a cross sectional view of a manhole with a leveling clip 20 installed, the method of using the invention is as follows. First, after installation of the riser rings 14, the adjustment bolts 32 are threaded into a number of manhole cover frame leveling clips 20 such that the bolt head 34 is nearest the shorter of the legs 26. Next, the "U" channel 24 of the manhole cover frame leveling clips 20 are receivably slid onto the outer peripheral flange 12 of the manhole cover frame 10 with the larger of the two legs 28 placed on the bottom surface of the flange so that the end of the adjusting bolt opposite head 34 will rest on the face of riser ring 14 and support the weight of the manhole cover frame 10 when the manhole cover frame 10 is positioned onto the riser ring 14 face. The manhole cover frame is then positioned onto the riser ring and the adjustment bolt 32 is turned to adjust the length of the portion of the bolt that protrudes from the bottom side of the clip until the top of the frame 10 reaches the desired position. Grout or cement is placed around the riser ring and leveling clips 20 to hold the ring in its final position. Protruding portions of the adjustment bolts (if any) are cut below the roadway surface. Finally, roadway material such as asphalt or cement 19 is used to fill in the hole (illustrated by dashed lines) up to the top of the frame. Typically there will be a plurality of clips 20 used in each leveling operation, for example, three or more. However, certain applications may require as few as one clip. In the preferred embodiment, the end of the bolt distal from head 34 contacts the riser ring, but the bolt can be positioned such that head 34 contacts the riser ring, rather than the other end of the bolt.

In fabrication of the clip 20, the tolerance of the width of the "U" channel 24 suitably is chosen to enable a friction fit between the clip 20 and the flange 12 so that installation of the clip onto the flange requires force to be exerted by a striking tool, such as a hammer.

In the preferred embodiment, the manhole cover frame leveling clip 20 is fabricated of steel; however, any appropriate material with good load bearing shear strength, such as an aluminum alloy or plastic, may be utilized.

In an alternate embodiment, the leveling clip hole is not threaded, but rather is of a smooth bore configuration wherein a leveling rod passes through the hole and bears the weight of the assembly at the underside of the leveling clip, for example, by use of any suitable adjustable stop member to allow height adjustment. A suitable stop comprises a sliding member that can be moved up and down the leveling rod but will maintain position by friction or by cooperative engagement with notches or the like in the rod.

Figure 4:
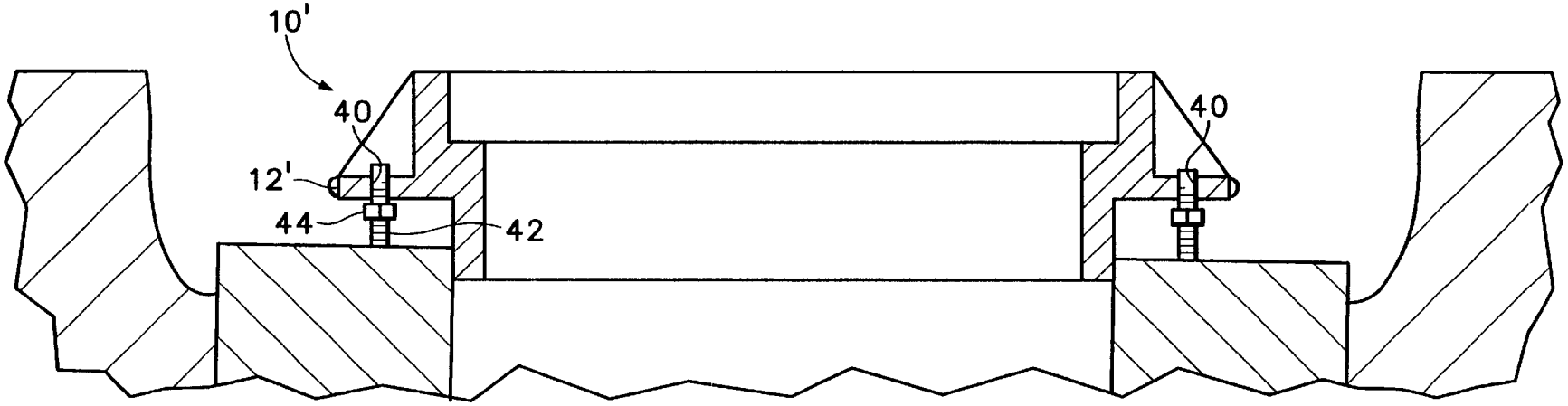
FIG. 4 is a cross sectional view of an alternative embodiment manhole frame leveling clip incorporated into a manhole cover frame.

In still a further embodiment, as illustrated in FIG. 4, the manhole cover frame 10' has an opening 40 defined in flange 12', the opening being suitably not threaded and of sufficient diameter so that a threaded rod 42 freely passes therethrough. The rod has a nut 44 threaded thereon and the top surface of the nut bears against the bottom surface of the flange 12' so as to support the frame 10'. The nut is threaded upwardly or downwardly along the length of the rod 42 to enable adjustment of the frame 10' as desired. Still further, an alternate rod 42' can be unthreaded and an engagement member 44' is substituted for the nut, wherein the engagement member can be secured at any desired location along the length of rod 42'. For example, a supporting disk member with a set screw can be provided such that the disk member engages the bottom of the flange 12' while the set screw frictionally secures the position of the disk along the length of the rod 42'. Still further, the aperture in the flange 12' can be threaded to receive a threaded rod or bolt therein.

Accordingly, plural embodiments are provided, either as pre-manufactured devices combined together with the manhole cover frames or as add-on adjustment members that can be applied in the field, as needed, to standard manhole cover frames.

While a plural embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A manhole cover frame leveling clip comprising:

a body with a groove formed in a face of said body so as to define an open and closed end of said groove, wherein said body is adapted for attachment to the manhole cover frame by receiving a portion of the manhole cover frame into said open end of said groove; and a leveling leg that is engageable with said body, whereby adjustment of said leveling leg enables a height and an angle of a surface of the manhole cover frame to be adjusted.

2. A manhole cover frame leveling clip according to claim 1 wherein said body has a threaded aperture defined therein, and formed generally perpendicular to the longitudinal axis of the groove and substantially parallel to the face of the body, for receiving said leveling leg.

3. A manhole cover frame leveling clip according to claim 1 wherein the groove is generally "U" shaped.

4. A manhole cover frame leveling clip according to claim 1 wherein the groove defines sides of said body that are not equal in length.

5. A manhole cover frame leveling clip according to claim 1 wherein the groove defines sides of said body that are substantially equal in length.

6. A manhole cover frame leveling clip according to claim 1 wherein said body is fabricated from a metal.

7. A manhole cover frame leveling clip according to claim 1 wherein said body is fabricated from a plastic.

8. A manhole cover frame leveling clip according to claim 1 wherein said leg is fabricated from a metal.

9. A manhole cover frame leveling clip according to claim 1 wherein said leg is fabricated from a plastic.

10. A manhole cover frame leveling clip according to claim 1 wherein said body is fabricated from a metal and said leveling leg is fabricated from a plastic.

11. A manhole cover frame leveling clip according to claim 1 wherein said body is fabricated from a plastic and said leveling leg is fabricated from a metal.

12. A manhole cover frame leveling clip according to claim 1 wherein said body is fabricated from a wood.

13. A manhole cover frame leveling clip according to claim 1 wherein said leveling leg comprises a bolt.

14. A manhole cover frame leveling clip according to claim 1 wherein said leveling leg comprises a threaded member.

15. A manhole cover frame leveling clip according to claim 1 wherein said body frictionally receives the manhole cover frame in said groove.

16. A manhole cover frame leveling clip comprising:

a body with a groove formed in a face of said body so as to define an open and closed end of said groove; and a leveling leg that is engageable with said body, wherein said groove has edges with rounded profiles for ease of installation.

17. A method for adjusting a manhole cover frame to conform to a roadway surface contour, comprising the steps of:

frictionally engaging at least one grooved body onto a peripheral flange of the manhole cover frame;

engaging a leveling leg with said body, such that said leveling leg contacts the surface supporting the manhole cover frame; and adjusting said body with said leveling leg to adjust the manhole cover frame height and angle to conform to the roadway surface contour.

18. The method for adjusting a manhole cover frame to conform to a roadway surface contour as in claim 17 wherein said leveling leg is a bolt further comprising a head and a threaded shaft wherein the bolt contacts the surface supporting the manhole cover frame.

19. The method for adjusting the top surface of a manhole cover frame to conform to a roadway surface contour as in claim 17 wherein said leveling leg is a bolt further comprising a head and a threaded shaft wherein the threaded shaft contacts the surface supporting the manhole cover frame.

20. The method for adjusting a manhole cover frame to conform to a roadway surface contour as in claim 17, wherein plural grooved bodies and legs are engaged, and said adjusting step comprises adjusting said plural bodies and legs.

21. A manhole cover frame leveling clip comprising:

a body with a groove formed in a face thereof and having an aperture located in said body formed generally perpendicular to a longitudinal axis of the groove; and a leveling leg, whereby attachment of at least one said leveling clip to the manhole cover frame enables the height and angle of the top surface of said manhole cover frame to be adjusted.

22. A manhole cover frame leveling apparatus comprising:

a clip member adapted to frictionally engage with the manhole cover frame; and a leveling leg that is engageable with said clip member for enabling adjustment of a height and angle of the manhole cover frame relative to a surface.

23. A manhole cover frame leveling apparatus according to claim 22 wherein said clip member comprises a member that engages a portion of the manhole cover frame.

24. A manhole cover frame leveling apparatus according to claim 22 wherein the manhole cover frame has an aperture defined therein and wherein said leveling leg at least partially passes therethrough, and whereby the engagement between said leveling leg and said clip member defines a height adjustment for the manhole cover frame.

25. A manhole cover frame leveling apparatus according to claim 22 wherein said leveling leg is threadably engageable with said clip member.

26. A manhole cover frame leveling apparatus according to claim 22 wherein said leveling leg is frictionally engageable with said clip member.

* * * * *